US005565228A

United States Patent [19]

Gics

[11] Patent Number: 5,565,228

[45] Date of Patent: Oct. 15, 1996

[54] OVENABLE FOOD PRODUCT TRAY AND AN OVENABLE FOOD PRODUCT PACKAGE

[75] Inventor: Paul W. Gics, Sewickley Heights, Pa.

[73] Assignee: Gics & Vermee, L.P., Sewickley Heights, Pa.

[21] Appl. No.: 434,130

[22] Filed: May 2, 1995

[51] Int. Cl.[6] ..... B62D 85/00

[52] U.S. Cl. ..... 426/107; 426/113; 426/114; 426/122; 426/123; 426/128; 426/234; 426/243; 426/87; 229/903; 219/730; 219/759; 206/564

[58] Field of Search ..... 426/107, 113, 426/114, 115, 122, 123, 124, 128, 244, 394, 87, 234, 243; 229/407, 903; 220/359; 156/324.4; 219/730, 732, 759; 206/557, 564

[56] References Cited

U.S. PATENT DOCUMENTS

| | | | |
|---|---|---|---|
| 3,160,326 | 12/1964 | Sturdevant et al. | 222/183 |
| 3,298,505 | 1/1967 | Stephenson | 426/122 X |
| 3,372,856 | 3/1968 | Erhart et al. | 229/125.19 X |
| 3,436,894 | 4/1969 | Sorenson | 53/478 |
| 3,449,183 | 6/1969 | Zelnick | 53/478 X |
| 3,458,380 | 7/1969 | Kipp | 156/309.6 |
| 3,495,758 | 2/1970 | Wienecke, Jr. | 229/125.38 |
| 3,567,104 | 3/1971 | Arslanian et al. | 229/14 |
| 3,785,544 | 1/1974 | Smith | 229/125.35 |
| 3,863,832 | 2/1975 | Gordon et al. | 229/125.35 |
| 4,065,583 | 12/1977 | Ahlgren | 426/113 X |
| 4,190,757 | 2/1980 | Turpin et al. | 425/243 X |
| 4,257,530 | 3/1981 | Faller | 220/469 |
| 4,351,473 | 9/1982 | Manizza | 229/125.35 X |
| 4,373,636 | 2/1983 | Hoffmann | 229/2.5 R |
| 4,398,077 | 8/1983 | Freedman et al. | 426/243 X |
| 4,496,815 | 1/1985 | Jorgensen | 219/759 X |
| 4,531,668 | 7/1985 | Forbes, Jr. | 229/125.35 X |
| 4,642,434 | 2/1987 | Cox et al. | 219/732 X |
| 4,676,857 | 6/1987 | Scharr et al. | 156/233 |
| 4,689,458 | 8/1987 | Levendusky et al. | 426/243 X |
| 4,701,585 | 10/1987 | Stewart | 219/732 X |
| 4,713,510 | 12/1987 | Quick et al. | 426/107 X |
| 4,763,790 | 8/1988 | McGeehins | 426/107 X |
| 4,794,005 | 12/1988 | Swiontek | 426/107 X |
| 4,831,224 | 5/1989 | Keefer | 426/107 X |
| 4,841,112 | 6/1989 | Peleg | 426/107 X |
| 4,870,233 | 9/1989 | McDonald et al. | 426/107 X |
| 4,899,882 | 2/1990 | Benner | 426/107 X |
| 4,916,280 | 4/1990 | Havette | 426/107 X |
| 4,917,748 | 4/1990 | Harrison | 156/230 |
| 4,939,332 | 7/1990 | Hahn | 426/107 X |
| 4,955,530 | 9/1990 | Rigby et al. | 229/125.35 X |
| 4,994,638 | 2/1991 | Iorns et al. | 426/113 X |
| 5,032,213 | 7/1991 | Thomas, Jr. | 156/69 X |
| 5,039,833 | 8/1991 | Woods | 426/107 X |
| 5,040,357 | 8/1991 | Ingemann | 53/478 |
| 5,090,615 | 2/1992 | Hopkins et al. | 229/125.35 |
| 5,126,518 | 6/1992 | Beckett | 426/107 |
| 5,217,765 | 6/1993 | Parks | 218/759 X |
| 5,231,268 | 7/1993 | Hall et al. | 219/759 X |
| 5,234,159 | 8/1993 | Lorence et al. | 229/125.35 |
| 5,310,977 | 5/1994 | Stenkamp et al. | 219/730 |
| 5,326,575 | 7/1994 | Spaulding | 426/87 |
| 5,352,465 | 10/1994 | Godnek et al. | 426/87 |
| 5,356,649 | 10/1994 | LaMotta et al. | 426/396 |
| 5,366,102 | 11/1994 | Bergner et al. | 215/100 R |
| 5,370,883 | 12/1994 | Saunier | 426/107 |
| 5,484,984 | 1/1996 | Gics | 426/107 X |

FOREIGN PATENT DOCUMENTS

| | | |
|---|---|---|
| 0327243 | 8/1989 | European Pat. Off. . |
| 0399981 | 11/1990 | European Pat. Off. . |
| 0276654 | 3/1992 | European Pat. Off. . |
| 0492052 | 7/1992 | European Pat. Off. . |
| 2164868 | 8/1973 | France . |
| 2629424 | 10/1989 | France . |
| 2046060 | 5/1983 | United Kingdom . |
| 8604880 | 8/1986 | WIPO . |
| 8805249 | 7/1988 | WIPO . |
| 9105448 | 8/1991 | WIPO . |

*Primary Examiner*—Esther Kepplinger
*Assistant Examiner*—Milton I. Cano
*Attorney, Agent, or Firm*—David V. Radack; Eckert Seamans Cherin & Mellott

[57] ABSTRACT

A food product tray including a base defining an opening and a floor member covering the opening. The floor member has an edge portion thereof secured to the base such that the floor member substantially directly supports the food product in the tray. A food product package is also provided.

15 Claims, 5 Drawing Sheets

OVENABLE FOOD PRODUCT TRAY AND AN OVENABLE FOOD PRODUCT PACKAGE

BACKGROUND OF THE INVENTION

This invention relates to an ovenable food product tray and an ovenable food product package, and more particularly to a food product tray that can be placed directly into a conventional or microwave oven along with the food product that is packaged therein.

Packaged foods, such as frozen pizzas, are sold extensively throughout the United States and the world. These packaged foods offer the consumer a convenient and a sometimes inexpensive alternative to preparing foods from "scratch". Increasingly, packaged foods are becoming microwavable. Many times, however, the food product must be removed from the food package and placed in a separate receptacle for heating in the microwave.

In order to avoid this extra step, ovenable food packages have been developed. For example, it is known to provide a package consisting of a box which contains a frozen pizza. In use, the box is opened and placed in the microwave oven along with the pizza and then subjected to microwave energy.

There are several problems associated with current ovenable food packages. For microwavable food packages, if the package rests on the microwave oven floor, a heat sink is created which leads to non-uniform heating of the food product. This non-uniform heating causes "cold spots" in the food product. In addition, paperboard materials which are used for the food packages tend to lose their stiffness and rigidity upon heating. This is because the paperboard has a moisture content which is vaporized by the microwave heating. Because of this loss of stiffness, more "heat sinking" can occur and in addition, after removing the package from the microwave oven, the food product is not well supported by the package, thus making it harder to carry the food product in the package.

What is needed, therefore, is an ovenable food product tray and an ovenable food product package that can be placed directly into a microwave or conventional oven which avoids the problems of prior art packages but which is also economical and easy to produce.

SUMMARY OF THE INVENTION

The invention has met or exceeded the above-mentioned needs. A food product tray is provided that has a base defining an opening and a floor member covering the opening. The floor member has a portion thereof secured to the base such that the floor member substantially directly supports the food product in the tray. The tray can be adapted for use in a microwave oven and accordingly the base is made of plastic and the floor member is made of paperboard having a plastic coating and further having a susceptor material sandwiched between the plastic coating and the paperboard. The floor member is preferably arranged so that the plastic coating faces the food product and the paperboard has an outer surface that is spaced from the support surface of the food heating apparatus when the tray is placed in the food heating apparatus.

A food product package is also disclosed which includes a tray as described above, the base of the tray having a sidewall extending therefrom. The sidewall terminates in a stepped flange including a first portion extending generally perpendicularly outward from the sidewall and a second portion extending generally perpendicularly from the second portion, the second portion terminating in a free edge. The package then has a lid with a portion secured to the first portion of the stepped flange of the sidewall in order to form the food product package.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
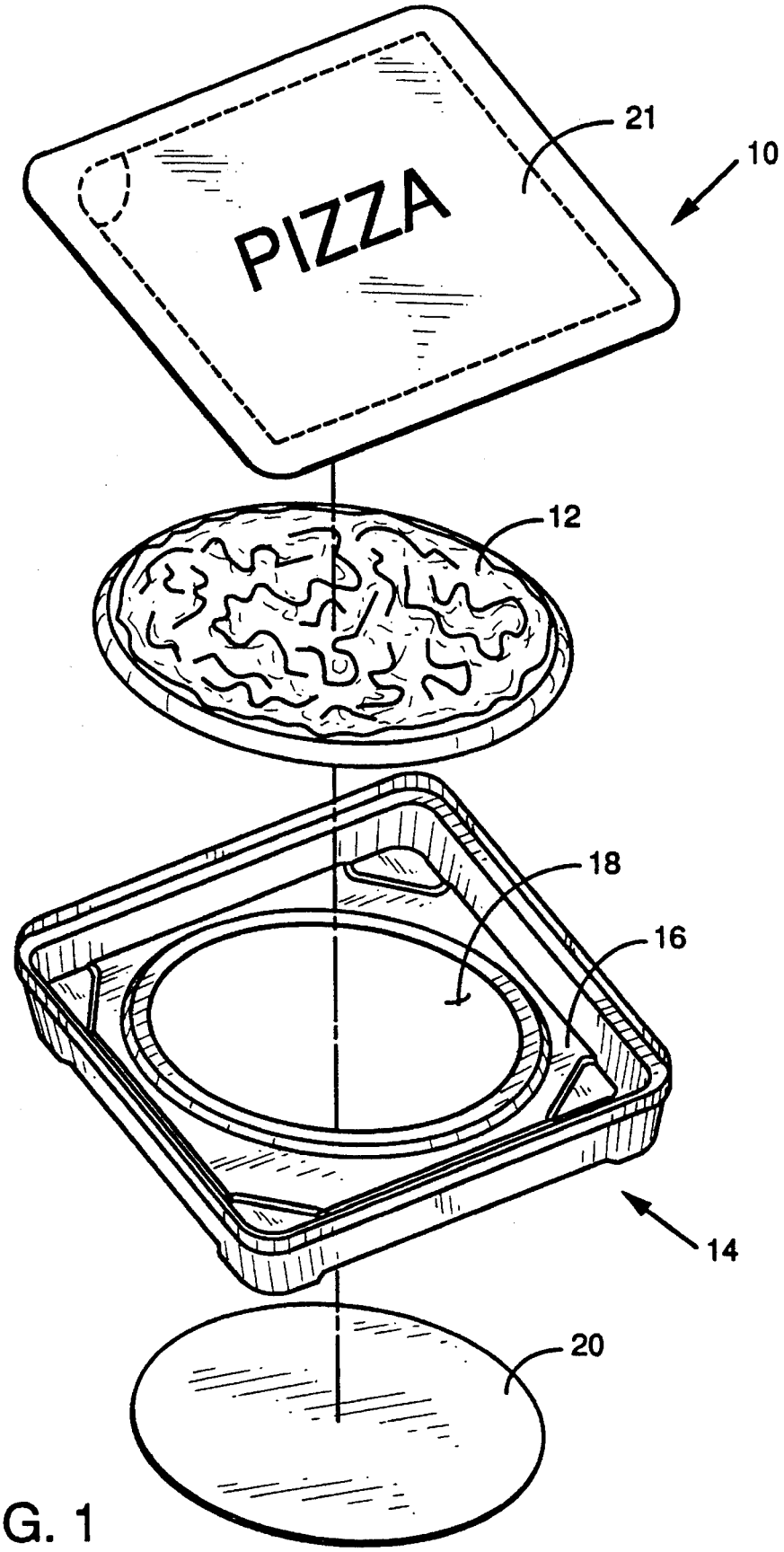
FIG. 1 is an exploded perspective view of the food product package of the invention.
Figure 2:
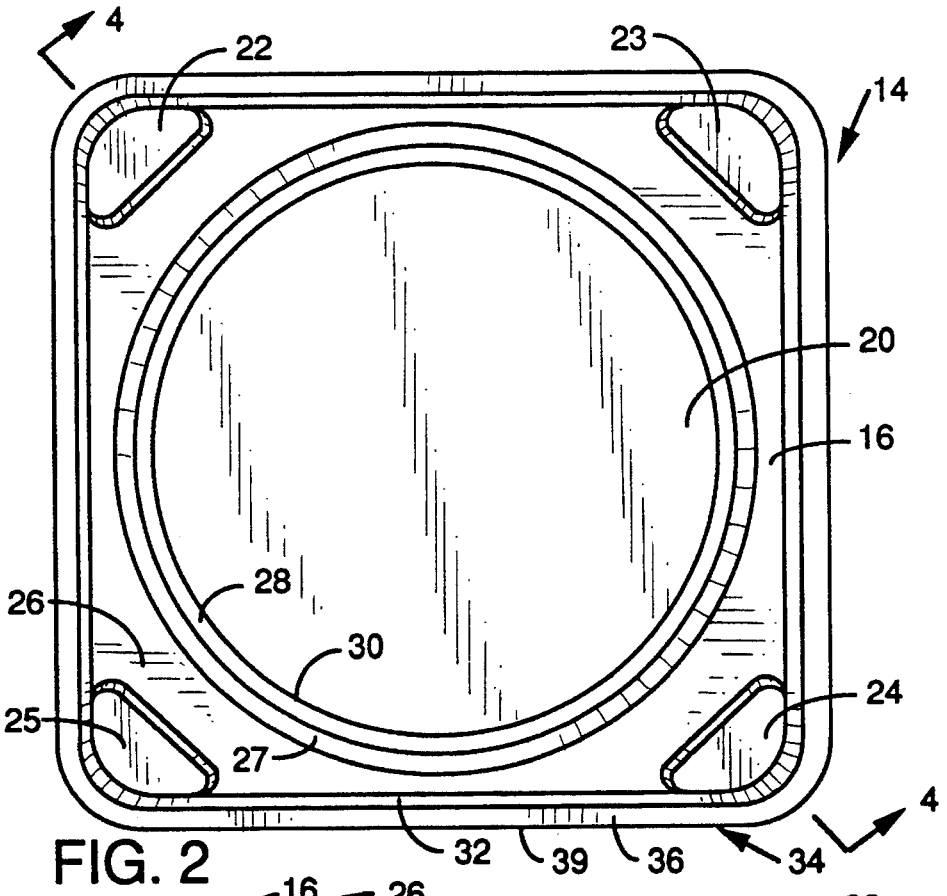
FIG. 2 is a top plan view of the food product tray of the invention.
Figure 3:
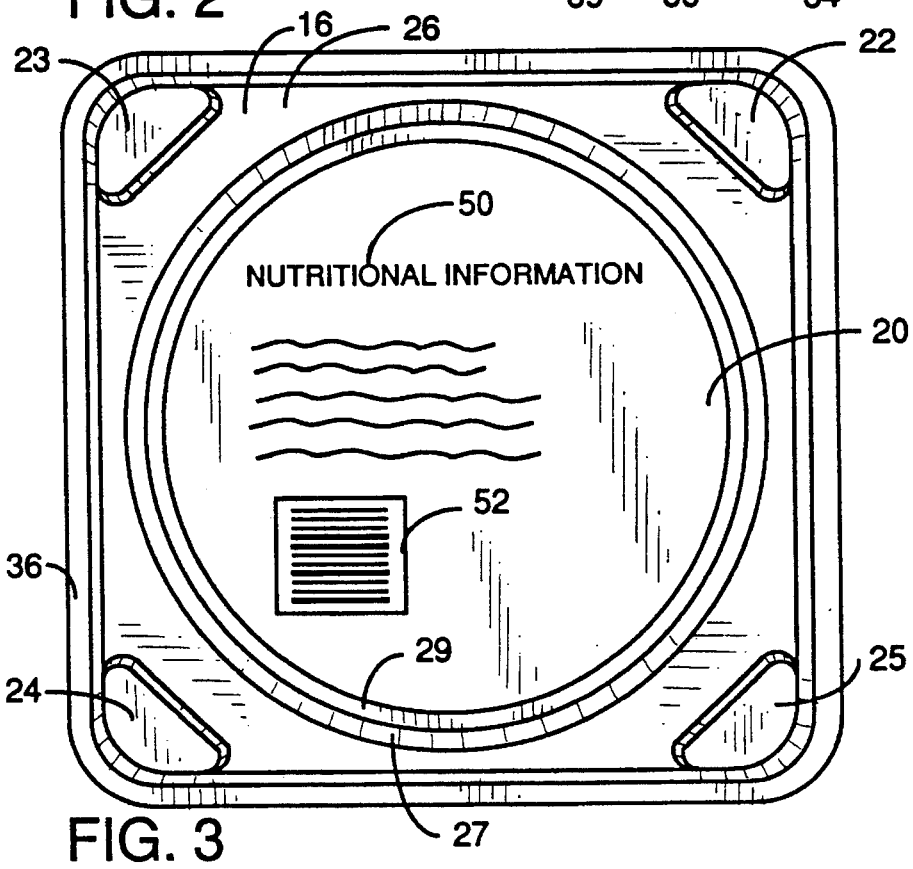
FIG. 3 is a bottom plan view of the food product tray of the invention.

Referring to FIG. 1, the food product package 10 of the invention is shown. The food product package 10 is designed to contain a food product, such as a frozen pizza 12, therein. The food product package 10 consists of a food product tray 14 which in turn consists of a base 16 defining a large circular opening 18 and a floor member 20 which is constructed and arranged to cover the opening 18. As will be seen later, the floor member 20 substantially directly supports the food product 12 in the food product tray 14. A lid 21 is provided to enclose the food product 12 in the package 10.

Referring now more particularly to FIGS. 2–5, the food product tray 14 will be described in more detail. The food product tray 14 is generally rectangular in shape, and, in fact, is shown in FIGS. 2–5 as being square. The food product tray 14, as was mentioned above, consists of a base 16 defining a large circular opening 18 and a floor member 20 which is constructed and arranged to cover the opening 18. The base 16 includes four downwardly depending leg members 22, 23, 24, 25, an intermediate plateau portion 26, an angularly disposed sidewall 27 and a flange portion 28, including an undersurface 29, having a free end 30 which defines the opening. A sidewall 32 extends from the periphery of the base 16 and terminates in a stepped flange 34 which includes a first horizontal portion 36 that extends generally perpendicularly outward from the sidewall 32 and a second vertical portion 38 that extends generally perpendicularly from the first horizontal portion 36. The second vertical portion 38 terminates in a free edge 39, the function of which will be discussed with respect to FIGS. 6–8.

Figure 4:
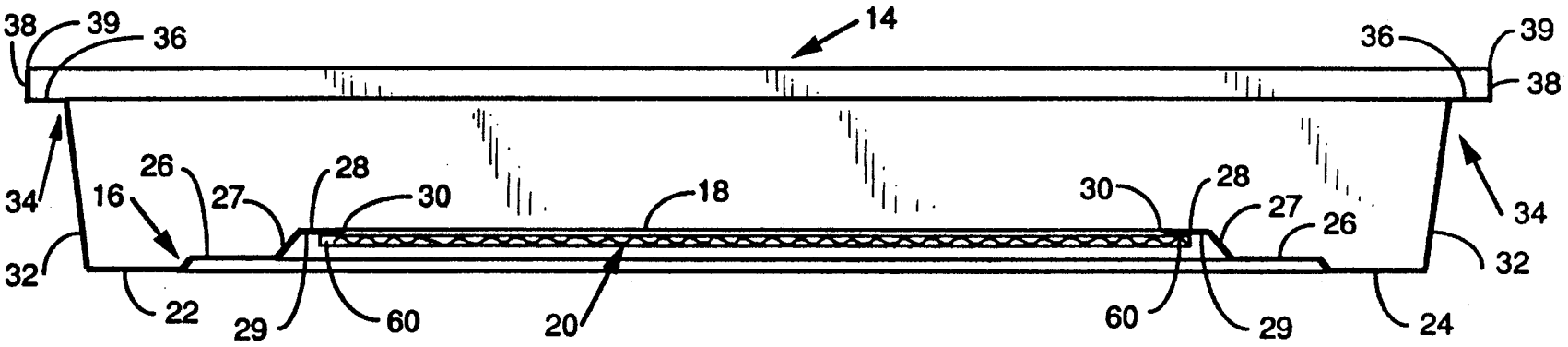
FIG. 4 is a cross-sectional view taken along line 4—4 of FIG. 2.

As can best be seen in FIG. 4, the floor member 20 is secured to the undersurface 29 of the flange portion 28 of the base 16. Thus, the floor member 20 provides a substantially direct support for the food product disposed in the food product tray 14.

Figure 5:
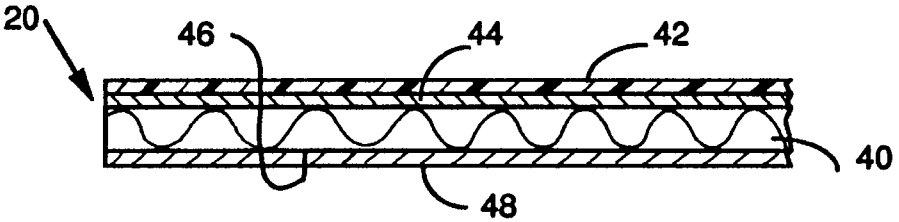
FIG. 5 is a detailed view of a vertical section taken through the floor member of the tray.

The base 16 and sidewall 32 are preferably made of a plastic material, and most preferably crystalized polyethylene terephthalate (hereinafter referred to as "C-PETE"). The floor member 20, on the other hand, is preferably made of a composite material that facilitates use of the food product tray 14 in a microwave oven. Referring to FIG. 5, the floor member 20 is composed of a paperboard material 40 having a polyester coating 42. Sandwiched between the paperboard material 40 and the polyester coating 42 is a microwave susceptor material 44, such as aluminum. It will be appreciated that the paperboard material 40 has an outer surface 46 which is adapted to received indicia 48, such as the nutritional information 50 and bar code information 52 shown in FIG. 3.

The floor member 20 is arranged on the food product tray 14 so that the polyester coating 42 contacts the food product when the food product is placed therein. The paperboard material 40 is disposed on the opposite side of the polyester coating 42, with the outer surface 46 thereof being exposed so that the indicia, such as nutritional information 50 and bar code information 52 are visible to the consumer. It will be appreciated that the floor member 20 is secured to the base 16 by providing a heat source that causes partial melting of both the polyester coating 42 of the portion 60 (FIG. 4) of the floor member 20 that contacts the flange portion 28 of the base 16 and the flange portion 28 itself. Once the heat source is removed, the portion 60 and flange portion 28 will be bonded together to form the food product tray 14.

Figure 6:
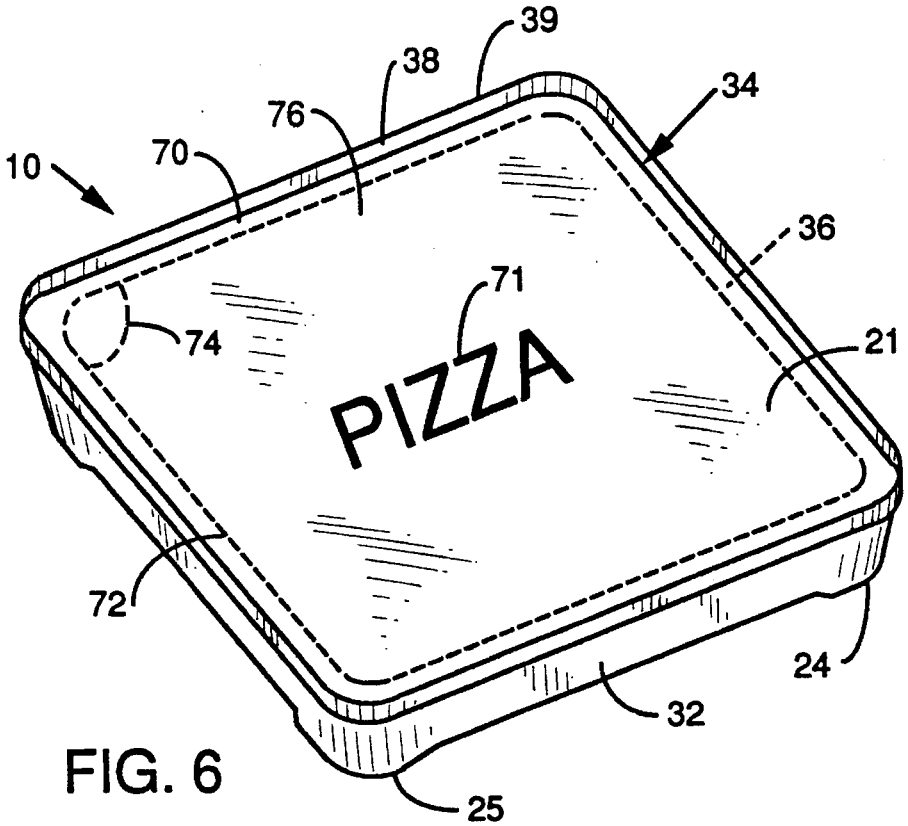
FIG. 6 is a perspective view of the assembled food product package of the invention showing the lid being in position on the base.
Figure 7:
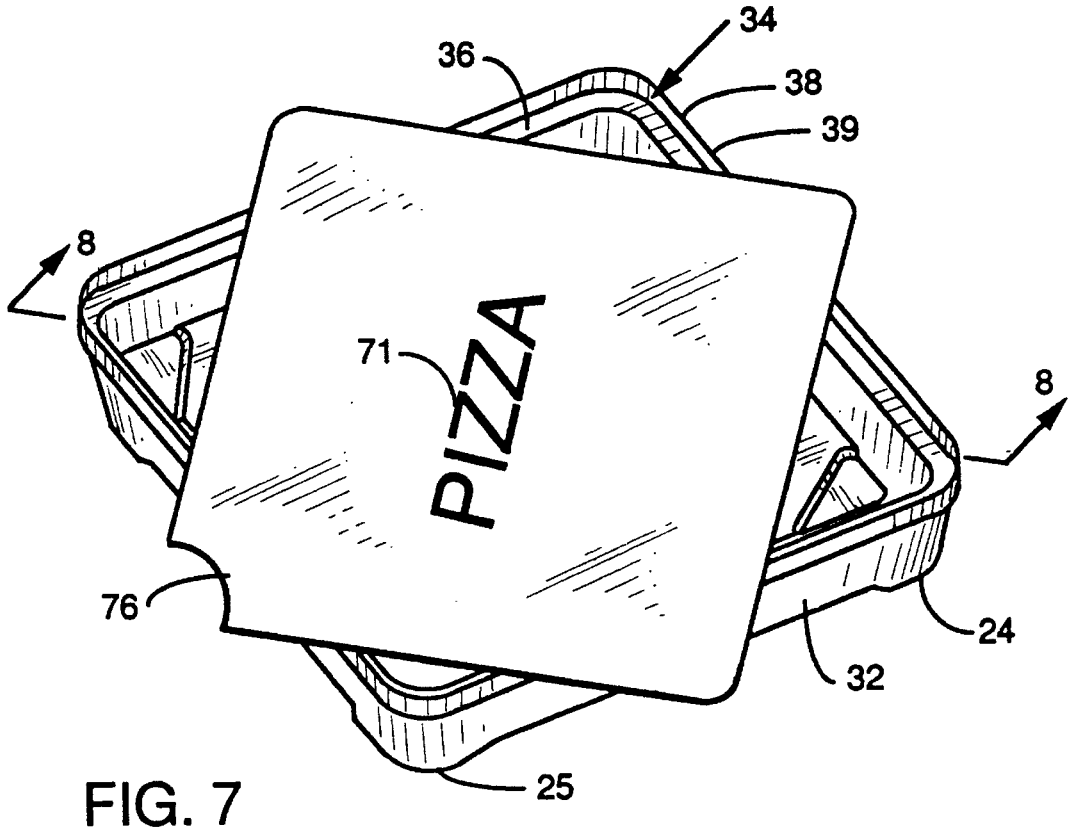
FIG. 7 is a view similar to FIG. 6 only showing the lid after it is removed from the tray and replaced on the tray so that the pizza is ready for cooking.

Referring now to FIG. 6, the food product package 10 is shown in its assembled form. The lid 21 also includes an outer edge portion 70 that is co-extensive with the first portion 36 of the stepped flange 34 of the sidewall 32. The outer edge portion 70 is preferably secured to the first portion by a hot-melt adhesive. The lid 21 is preferably made of paperboard and is printed with indicia 71 on the outer surface thereof. The lid 21 includes a score line 72 which facilitates removing a portion of the lid 21 from the package 10. It is further preferred to provide a finger tab defined by score line 74. In use, a consumer breaks the score line 74 and places a finger underneath the lid 21 and pulls the lid 21 away from the corner in which score line 74 is disposed. Score line 72 then facilitates tearing of a portion of the lid 21. Score lines 72 and 74 define a removable lid portion 76 which is totally removed from the secured edge portion 70.

Once the removable lid portion 76 is completely separated from the edge portion 70, it can be positioned such that it rests on free edge 39 of the stepped flange 34 of sidewall 32. It will be appreciated that the removable lid portion 76 is skewed from its original position so that a space 78 (FIG. 8) is created between the top of the pizza 12 and the removable lid portion 76. This space 78 allows the steam that is created when heating the pizza to vent and also allows the steam to form a "steam blanket" in the space 78 in order to enhance melting of the cheese on top of the pizza 12.

Figure 8:
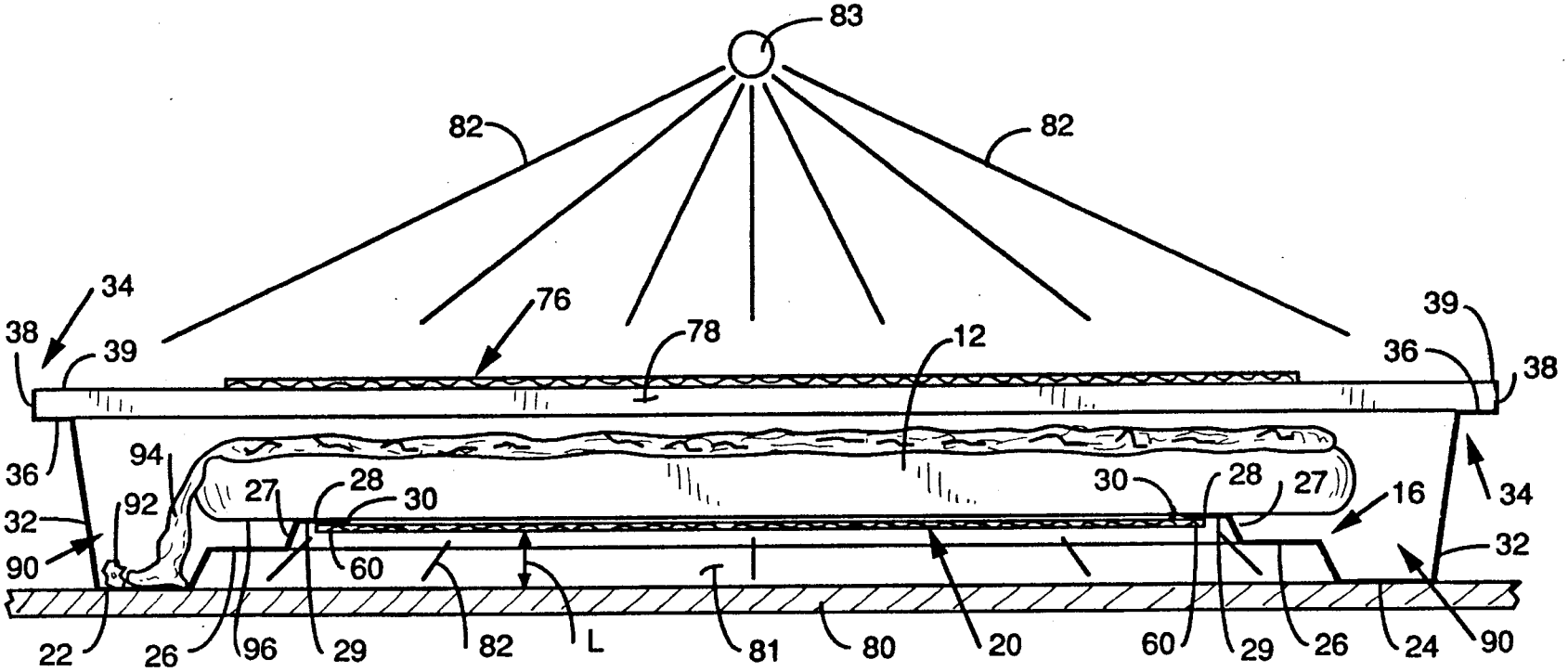
FIG. 8 is a cross-sectional view taken along line 8—8 of FIG. 7.

FIG. 8 also shows another feature of the invention. The floor member 20 is elevated from the support surface 80 of the microwave oven (not shown) by a length L to create a space 81. This length L is preferably at least one-quarter of an inch. The benefits of this spacing are two-fold: first, the floor member 20 and the support surface 80 do not act as a heat sink to draw away the heat created by the microwaves 82 from microwave source 83 in cooking the pizza 12. The microwaves 82 are able to enter into the space 81 in order to create uniform heating of the entire pizza 12 and thus eliminate cold spots in the pizza 12. Second, the outer surface 46 of the floor member 20 which contains indicia 48 printed on the outer surface is also spaced from the support surface 80 of the microwave oven. In this way, melting of the print used to create the indicia 48 is resisted, thus avoiding undesired transfer of the printing from the floor member 20 to the support surface 80 of the microwave oven.

It will be appreciated that the microwaves 82 will strike the floor member 20 and thus heat the floor member 20 to a very high temperature due to the presence of the microwave susceptor material 44 in the floor member 20. This will insure a thoroughly cooked and non-soggy pizza crust for the pizza 12.

FIG. 8 also shows the collection reservoir 90 formed by the base which serves the dual purpose of collecting any loose toppings 92 from the pizza 12 and also any melted cheese 94 that cascades over the side of the pizza 12 while it is cooking. This latter function resists "wicking" which is when melted cheese comes between the pizza crust 96 and the floor member 20 and thus cause sticking of the pizza crust 96 to the floor member 20.

It will be appreciated that an ovenable food product tray and an ovenable food product package have been disclosed. The food product tray and package contain two surfaces for printing indicia thereon, and is made of materials which produce a uniformly cooked and non-soggy food product.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A microwavable tray for a food product, said tray supporting said food product when said food product is placed into a food heating apparatus having a support surface, said tray comprising:

a plastic base, said base including a flange having a free edge which defines an opening;

sidewalls extending from said base; and a rigid floor member covering said opening, said floor member having an edge portion thereof such that said floor member substantially directly supports a food product in said tray, said floor member being made of paperboard having a plastic coating and further having a susceptor material sandwiched between said plastic coating and said paperboard, said edge portion of said floor member being secured to said flange by said plastic coating of said floor member in order to form said tray.

2. The tray of claim 1, wherein said base is made of crystallized polyethylene terephthalate; and said plastic coating is a polyester coating.

3. The tray of claim 2, wherein said floor member is arranged so that said polyester coating faces said food product and said paperboard has an outer surface that is spaced from said support surface of said food heating apparatus when said tray is placed in said food heating apparatus.

4. The tray of claim 3, wherein said outer surface of said paperboard has indicia thereon.

5. The tray of claim 4, wherein the space between said support surface and said floor member is at least one-quarter of an inch.

6. The tray of claim 5, wherein said base has at least one downwardly depending leg member with a portion thereof contacting said support surface, said leg member cooperating with said floor member to create said space between said floor member and said support surface.

7. The tray of claim 1, wherein said flange includes an undersurface facing said support surface when said tray is in said food heating apparatus and said edge portion of said floor member is bonded to said undersurface.

8. The tray of claim 1, wherein said tray is generally rectangular in shape;

said opening is generally circular; and said floor member is generally circular.

9. The tray of claim 8, wherein said food product is a generally circular pizza; and said tray is dimensioned so that said sidewalls generally circumscribe said generally circular pizza.

10. The tray of claim 9, wherein said base defines a collection reservoir disposed on the periphery of said base for collecting portions of said food product that become dislodged therefrom.

11. The tray of claim 10, wherein said pizza includes a pizza crust with cheese toppings; and said collection reservoir receives any melted cheese that cascades over the sides of said pizza crust during heating of said pizza in said food heating apparatus wherein wicking of said pizza crust to said floor member is resisted.

12. A package for a food product comprising:

a tray adapted for use in a microwave oven including a plastic base having a flange with a free end, said free end defining an opening, said base including a sidewall extending therefrom terminating in a stepped flange including a first portion extending generally perpendicularly outwardly from said sidewall and a second portion extending generally perpendicularly from said first portion, said second portion terminating in a free edge;

a rigid floor covering said opening made of paperboard having a plastic coating and further having a susceptor material sandwiched between said plastic coating and said paperboard, said floor member having an edge portion thereof secured to said base such that said plastic coating of said floor member is bonded to said flange of said base in order to form said tray so that said floor member substantially directly supports a food product in said tray; and a lid having a portion secured to said first portion of said stepped flange of said sidewall in order to form said food product package.

13. The package of claim 12, wherein said lid is scored to facilitate complete removal of a removable lid portion.

14. The package of claim 13, wherein said scoring defines a finger tab to facilitate removal of said removable lid portion.

15. The package of claim 14, wherein said removable lid portion is dimensioned so that after removal thereof, said removable lid portion can rest on said free edge wherein a space is created between said removable lid portion and said food product.

* * * * *